US009234261B2

(12) United States Patent
Tetyukhin et al.

(10) Patent No.: US 9,234,261 B2
(45) Date of Patent: Jan. 12, 2016

(54) METHOD FOR THE MELTING OF NEAR-BETA TITANIUM ALLOY CONSISTING OF (4.0-6.0) WT % AL-(4.5-6.0) WT % MO-(4.5-6.0) WT % V-(2.0-3.6) WT % CR-(0.2-0.5) WT % FE-(0.1-2.0) WT % ZR

(75) Inventors: Vladislav Valentinovich Tetyukhin, Moscow (RU); Igor Vasilievich Levin, Verkhnaya Salda/Sverdlovskaya obl. (RU); Natalya Igorevna Levina, legal representative, Verkhnaya Salda/Sverdlovskaya obl. (RU)

(73) Assignee: Public Stock Company, "VSMPO-AVISMA Corporation ", Sverdlovsk Region, Verkhnyaya Salda (RU)

( * ) Notice: Subject to any disclaimer, the term of this patent is extended or adjusted under 35 U.S.C. 154(b) by 0 days.

(21) Appl. No.: 13/876,025

(22) PCT Filed: Sep. 23, 2011

(86) PCT No.: PCT/RU2011/000731

§ 371 (c)(1),
(2), (4) Date: May 31, 2013

(87) PCT Pub. No.: WO2012/044205

PCT Pub. Date: Apr. 5, 2012

(65) Prior Publication Data

US 2013/0340569 A1 Dec. 26, 2013

(51) Int. Cl.

| | |
|---|---|
| ***C22C 14/00*** | (2006.01) |
| ***C22F 1/18*** | (2006.01) |
| ***C22B 9/20*** | (2006.01) |
| ***C22C 1/03*** | (2006.01) |

(52) U.S. Cl.
CPC ... *C22C 1/03* (2013.01); *C22B 9/20* (2013.01); *C22C 14/00* (2013.01); *C22F 1/183* (2013.01)

(58) Field of Classification Search
CPC ..... C22C 14/00; C22C 1/03; C22C 9/20
USPC ..... 75/10.64, 10.26; 420/590
See application file for complete search history.

(56) References Cited

U.S. PATENT DOCUMENTS

| | | | | |
|---|---|---|---|---|
| 4,606,886 | A | 8/1986 | Neal | |
| 4,684,506 | A * | 8/1987 | Hahn et al. | 420/552 |
| 5,332,545 | A | 7/1994 | Love | |
| 5,980,655 | A * | 11/1999 | Kosaka | C22C 14/00 148/421 |
| 2003/0116233 | A1 * | 6/2003 | Tetyukhin et al. | 148/421 |
| 2007/0102073 | A1 * | 5/2007 | Veeck | C22C 14/00 148/671 |
| 2012/0181385 | A1 * | 7/2012 | Fanning | 244/100 R |

FOREIGN PATENT DOCUMENTS

| | | | | |
|---|---|---|---|---|
| CN | 1031569 | | 3/1989 | |
| CN | 101010439 | | 8/2007 | |
| CN | 101760667 | | 6/2010 | |
| EP | 1172450 | | 1/2002 | |
| EP | 1882752 | A2 * | 1/2008 | C22C 14/00 |
| RU | 2263721 | C2 * | 11/2005 | |
| RU | 2269854 | | 2/2006 | |
| RU | 2396366 | | 8/2010 | |
| SU | 1731851 | | 5/1992 | |
| WO | WO-03095690 | | 11/2003 | |

OTHER PUBLICATIONS

Derwent ACC No. 1972-33152T for the patent family including SU 309061 published Jul. 15, 1969.*
Tirkina et al. SU 209061 A1 (patent). Published Dec. 1971. Machine translation of description.*
"Federal Institute of Industrial Property Search Report", RU 2010139693, our file 324.0005USWO, mailed Dec. 22, 2011 (2 pages).
"International Report on Patentability", for PCT/RU2011/000731 (our file 324.0005USWO), mailed Jan. 18, 2013 (3 pages).
"PCT International Search Report", from International Application No. PCT/RU2011/000731, mailed Jan. 13, 2012 (1 page).
"Written Opinion", for PCT/RU2011/000731 (our file 324.0005USWO), mailed Jan. 19, 2012 (3 pages).
Office Action, for CN 201180046732.9 mailed Oct. 8, 2014 (5 pages).

* cited by examiner

*Primary Examiner* — George Wyszomierski
*Assistant Examiner* — Tima M McGuthry Banks
(74) *Attorney, Agent, or Firm* — Pauly, DeVries Smith & Deffner, L.L.C.

(57) ABSTRACT

This invention relates to nonferrous metallurgy, namely to manufacture of near-beta titanium alloys containing titanium and such alloying elements as molybdenum, vanadium, chromium, zirconium, iron and aluminum. The provided alloy contains the following components, in weight percentages: molybdenum—25 to 27; vanadium—25 to 27; chromium—14 to 16; titanium—9 to 11; with balance aluminum and iron and zirconium in the form of commercially pure metals. The technical result of this invention is capability to produce a near-beta titanium alloy with high chemical homogeneity alloyed by refractory elements and having aluminum content ≤6 wt %, wherein the alloy is characterized by a combination of stable high strength and high impact strength.

5 Claims, No Drawings

METHOD FOR THE MELTING OF NEAR-BETA TITANIUM ALLOY CONSISTING OF (4.0-6.0) WT % AL-(4.5-6.0) WT % MO-(4.5-6.0) WT % V-(2.0-3.6) WT % CR-(0.2-0.5) WT % FE-(0.1-2.0) WT % ZR

CROSS-REFERENCE TO RELATED APPLICATIONS

This application is a national stage application under 35 U.S.C. 371 of International Patent Application Serial No. PCT/RU2011/000731, entitled "METHOD FOR MELTING A PSEUDO 13-TITANIUM ALLOY COMPRISING (4.0-6.0)% AL—(4.5-6.0)% MO—(4.5-6.0)% V—(2.0-3.6)% CR—(0.2-0.5)% FE—(0.1-2.0)% ZR", filed Sep. 23, 2011, which claims the benefit of Russian Provisional Patent Application No. 2010139693 filed Sep. 27, 2010, the disclosures of which are incorporated herein by reference.

FIELD OF THE INVENTION

This invention relates to nonferrous metallurgy, namely to the manufacture of near-beta titanium alloys containing titanium and such alloying elements as molybdenum, vanadium, chromium, zirconium, iron and aluminum.

BACKGROUND

There are known alloys that contain the specified elements (RF patents No. 2283889 and No. 2169782). Invention of these alloys has been preconditioned by the current trends to increase weight-and-size characteristics of commercial airplanes, which resulted in the increase of sections of highly loaded components such as landing gears. At the same time material requirements has become more strict enforcing good combination of high tensile strength and high impact strength. These structural components are made either of high-alloyed steels or titanium alloys. Substitution of titanium alloys for high-alloyed steels is potentially very advantageous, it helps to achieve at least 1.5 times reduction of component's weight, minimize corrosion and functional problems. However, despite beneficial specific strength behavior of titanium alloys as compared with steel, their use is limited by processing capabilities, in particular, difficulties with uniform mechanical properties for sections sizes exceeding 3 inches in thickness. The said alloys overcome this conflict and can be used to manufacture a wide range of critical components including large forgings and die forgings with section sizes over 150-200 mm and also small semi-products, such as bar, plate with thickness up to 75 mm, which are widely used for the aircraft application including fastener application.

The available methods of melting of homogeneous ingots containing high amounts of refractory β stabilizers, which are characteristic of these alloys, do not meet current requirements to the full extent.

It is well known, that α+β alloy containing 7% aluminum and 4% molybdenum with balance titanium can be easily produced with homogeneous chemistry by melting Al—Mo master alloys and titanium sponge. There are also widely known similar double and triple master alloys, such as Al—V, Al—Sn, Al—Mo—Ti and Al—Cr—Mo, which can be used together with pure metals, as applicable, to melt any low- and medium-alloyed titanium alloys ("Melting and casting of titanium alloys", A. L. Andreyev, N. F. Anoshkin et al., M., Metallurgy, 1994, pg. 127, table 20 [1]).

However, these and similar master alloys cannot be used for melting of high-alloyed alloys with the relatively low (5%) content of aluminum and high content of refractory, strongly segregating and volatile elements (Mo, V, Cr, Fe, Zr).

There is a known master alloy (RF patent No. 2238344, IPC C22C21/00, C22C1/03) used for melting of titanium alloys, which contains aluminum, vanadium, molybdenum, iron, silicon, chromium, zirconium, oxygen, carbon and nitrogen in the following weight percentages:

Vanadium 26-35
Molybdenum 26-35
Chromium 13-20
Iron 0.1-0.5
Zirconium 0.05-6.0
Silicon 0.35 max.
Each element in the group
containing Oxygen,
Carbon and Nitrogen 0.2 max.
Aluminum balance.

Pilot ingot heats melted (double vacuum-arc remelt (VAR)) using similar master alloy enabled production of high-alloyed titanium alloys with controlled content of aluminum and high chemical homogeneity of the ingot.

Comprehensive mechanical testing of melted alloys revealed instability of properties and relatively low impact strength, which is detrimental to commercial value of these alloys and prevents their application in the aerospace sector.

The major root cause of the above is formation of thin oxide layers at the boundaries of matrix grain, which is the result of presence of oxygen in master alloy constituents and also of silicon, but to a considerably lesser extent, which deteriorates ductility.

There is a known method for melting of titanium alloy ingots, which includes master alloy preparation, weighing, blending and portion-by-portion compaction of solid and loose constituents comprising titanium sponge, master alloy and recyclable scrap to make a consumable electrode for its subsequent double vacuum-arc remelting or a single scull melting followed by a single vacuum-arc remelting ("Melting and casting of titanium alloys", A. L. Andreyev et al., M., Metallurgy, 1994, pgs. 125-128, 188-230)—prototype.

The known method has a certain drawback, i.e. the introduction of refractory alloying elements in the form of pure metals during melting of titanium alloys (molybdenum in particular), no matter how finely crushed they are, might lead to inclusions that can survive even the second remelt. That is why these elements are introduced in the form of intermediate alloys—master alloys. Manufacture of such master alloys for commercial melting of titanium alloys is cost effective only when done by aluminothermic process. Here a complex master alloy contains considerable amounts of oxygen, which adds to oxygen in other components of the blend and also in the residual atmosphere of vacuum-arc furnace, which leads to critical deterioration of mechanical behavior of titanium alloy. Oxygen is absorbed by titanium and promotes formation of interstitial structures at the grain boundaries having high strength, hardness (maybe twice as high as that of titanium) and low ductility. Specialists are aware of the fact that fracture toughness considerably increases with decreasing oxygen content in titanium matrix.

SUMMARY

The method for melting of near-β titanium alloy consisting of (4.0-6.0)% Al—(4.5-6.0)% Mo—(4.5-6.0)% V—(2.0-3.6)% Cr—(0.2-0.5)% Fe—(0.1-2.0)% Zr, which includes preparation of master alloy having two or more alloying elements, alloying of the blend, fabrication of consumable electrode and alloy melting in vacuum-arc furnace is provided. The peculiarity of this method is the introduction of Al, Mo, V, Cr into the blend in the form of a complex mater alloy made via aluminothermic process and having the following weight percentages of the elements:

Molybdenum—25-27
Vanadium—25-27
Chromium—14-16
Titanium—9-11
Aluminum—balance, while Iron and Zirconium are introduced as pure metals. This alloy is produced via double melting minimum with the first melt being either vacuum-arc remelt or scull—consumable electrode method.

DETAILED DESCRIPTION

The objective of this invention is manufacture of near-beta titanium alloy with highly homogeneous chemistry by alloying it with refractory elements and having aluminum content ≤6%, which is characterized by stable high strength behavior combined with high impact strength.

The set objective can be achieved by melting of near-β titanium alloy consisting of (4.0-6.0)% Al—(4.5-6.0)% Mo—(4.5-6.0)% V—(2.0-3.6)% Cr, (0.2-0.5)% Fe—(0.1-2.0)% Zr with preliminary preparation of master alloy containing two or more alloying elements, alloying of the blend, fabrication of consumable electrode and melting of the alloy in vacuum-arc furnace.

Al, Mo, V and Cr are introduced into the blend in the form of a complex master alloy made via aluminothermic process and having the following weight percentages of its constituents:

Molybdenum—25-27
Vanadium—25-27
Chromium—14-16
Titanium—9-11
Aluminum—balance, while iron and zirconium are introduced as commercially pure metals. The alloy is produced via double remelt minimum, with the first melt being either vacuum-arc remelt or scull—consumable electrode method.

The nature of this invention lies in a high quality of the alloy, which is preconditioned by the ratio of alloying elements matching each other, homogeneity and purity of the alloy (freedom from inclusions). High strength of this alloy is mainly supported by β phase due to relatively wide range of β stabilizers (V, Mo, Cr, Fe).

As stated above, the introduction of commercially pure metals, such as molybdenum, into the melt during vacuum-arc melting leads to incomplete fusion of individual lumps, which in its turn results in chemical inhomogeneity. That is why refractory metals are introduced into the melt in the form of master alloys. The optimum composition of a complex master alloy has been determined experimentally. This master alloy contains molybdenum, chromium, vanadium, aluminium and titanium. When the content of main master alloy components is below the lower limit, the minimum required content of aluminum (5%) in the alloy cannot be achieved. When the content of main master alloy components is above the upper limit, the melting point of master alloy increases while its brittleness dramatically deteriorates, which makes crushing difficult or impossible. Titanium is introduced to stabilize thermal reaction. Melting point of this master alloy is 1760° C., which is considerably lower than the temperature in the melting zone thus ensuring its complete fusion.

Zirconium is introduced into the melt in the form of commercially pure metal with the cross section size up to 20 mm. It is a known fact that zirconium affinity for oxygen is higher than that of titanium. Zirconium reactivity during its introduction into the melt in the form of commercially pure metal rather than master alloy component considerably increases. Presence of quite large fractions in the blend provides for its interaction with oxygen during the required time period, which prevents active absorption of oxygen by titanium. Zirconium facilitates redistribution of oxygen from the surface of titanium matrix grains thus hindering formation of interstitial structures (which are hard and have low ductility) in this zone. Iron is introduced in the form of steel punchings or finely crushed chips.

The effect of this is quite unexpected: high fracture toughness and high strength of the alloy.

When large amounts of recyclable scrap are introduced into the blend, it's feasible to perform the first melt via scull—consumable electrode method. This will guarantee good blending of chemistry components of the melted alloy.

Experimental Section

Examples of the actual embodiment of the invention.

1. A 560 mm diameter ingot having the following chemical composition was double vacuum-arc melted:

Al 5.01%
V 5.36%
Mo 5.45%
Cr 2.78%
Fe 0.36%
Zr 0.65%
O 0.177%

The ingot was converted to 250 mm diameter billets with subsequent testing of the metal properties. The following results of mechanical properties were obtained after appropriate heat treatment:

Tensile strength of 1293 MPa
Yield strength of 1239 MPa
Elongation of 2%
Reduction of area of 4.7%
Fracture toughness of 66.3 MPa√m 2. A 190 mm diameter ingot having the following chemical composition was double vacuum-arc melted:

Al 4.92%
V 5.23%
Mo 5.18%
Cr 2.92%
Fe 0.40%
Zr 1.21%
O 0.18%

The ingot was converted to 32 mm diameter bars with subsequent testing of the metal properties. The following results of mechanical properties were obtained after appropriate heat treatment:

Tensile strength of 1427 MPa
Yield strength of 1382 MPa
Elongation of 12%
Reduction of area of 40%
Fracture toughness of 52.2 MPa√m The claimed method enables production of alloys with uniform and high level of ultimate tensile strength and high fracture toughness.

The invention claimed is:

1. A method for forming a near β-titanium alloy comprising (4.0-6.0)% Al—(4.5-6.0)% Mo—(4.5-6.0)% V—(2.0-

3.0)% Cr, (0.2-0.5)% Fe—(0.2-2.0)% Zr and the balance Ti, the method comprising the steps of:

(i) a fabrication of a consumable electrode comprising titanium with incorporation of alloying elements into an electrode charge material by combining a complex master alloy comprising Al, Mo, Cr, V, Ti with pure elements Fe and Zr; and (ii) the β-titanium alloy is formed by at least a double melting of the consumable electrode, wherein the first melting is done by vacuum arc melting or skull melting, and the second and subsequent meltings are done by vacuum arc melting.

2. The method of claim 1 wherein the complex master alloy is made with an aluminothermic process and has the following composition: (25-27) wt. % Mo, (25-27) wt. % V, (14-16) wt. % Cr, (9-11) wt. % Ti and the balance Al.

3. The method of claim 1 wherein zirconium is incorporated into the consumable electrode charge materials as fractions having a section of up to 20 mm.

4. The method of claim 1 wherein iron is incorporated into the consumable electrode charge material as steel cuttings or fine-crushed chips.

5. The method of claim 1 wherein the alloy is free of an interstitial matrix oxide layer.

* * * * *